US007458667B2

(12) United States Patent
Kitabatake et al.

(10) Patent No.: US 7,458,667 B2
(45) Date of Patent: Dec. 2, 2008

(54) INK CONTAINER WITH LIGHT-EMITTING UNIT TO CONVEY INFORMATION

(75) Inventors: Kenji Kitabatake, Kawasaki (JP); Kimiyuki Hayasaki, Yokohama (JP); Nobuyuki Hatasa, Kawasaki (JP); Takayuki Ochiai, Inagi (JP); Shinji Watanabe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 322 days.

(21) Appl. No.: 11/300,093

(22) Filed: Dec. 14, 2005

(65) Prior Publication Data

US 2006/0139421 A1 Jun. 29, 2006

(30) Foreign Application Priority Data

Dec. 24, 2004 (JP) ..... 2004-374490

(51) Int. Cl.
*B41J 2/175* (2006.01)
*B41J 29/393* (2006.01)

(52) U.S. Cl. ..... 347/86; 347/19

(58) Field of Classification Search ..... 347/19, 347/86, 87, 85, 84
See application file for complete search history.

(56) References Cited

U.S. PATENT DOCUMENTS

| | | | | |
|---|---|---|---|---|
| 5,616,929 | A | 4/1997 | Hara | |
| 5,975,665 | A | 11/1999 | Torigoe | |
| 6,302,535 | B1 | 10/2001 | Sturgeon | |
| 6,422,675 | B1 * | 7/2002 | Tomomatsu | 347/7 |
| 6,431,680 | B1 | 8/2002 | Shinada | |
| 6,619,776 | B2 * | 9/2003 | Yoshiyama et al. | 347/7 |
| 6,916,076 | B2 * | 7/2005 | Yoshiyama et al. | 347/7 |
| 7,014,289 | B1 * | 3/2006 | Matsuda | 347/19 |
| 7,284,815 | B2 | 10/2007 | Uejima | |
| 2006/0082625 | A1 * | 4/2006 | Kotaki et al. | 347/86 |
| 2006/0087538 | A1 * | 4/2006 | Amma et al. | 347/86 |

FOREIGN PATENT DOCUMENTS

| | | |
|---|---|---|
| JP | 04-275156 | 9/1992 |
| JP | 04-275156 A | 9/1992 |
| JP | 07-218321 | 8/1995 |
| JP | 08-112908 | 5/1996 |
| JP | 08-114488 | 5/1996 |
| JP | 2000-326604 | 11/2000 |
| JP | 2000-334999 | 12/2000 |
| JP | 2001-246760 | 9/2001 |
| JP | 2001-328273 | 11/2001 |
| JP | 2002-301829 | 10/2002 |
| JP | 2002-301829 A | 10/2002 |
| JP | 2003-011387 | 1/2003 |
| JP | 2003-276245 | 9/2003 |
| JP | 2005-231356 | 9/2005 |

* cited by examiner

*Primary Examiner*—Stephen D Meier
*Assistant Examiner*—Rene Garcia, Jr.
(74) *Attorney, Agent, or Firm*—Canon USA Inc IP Div

(57) ABSTRACT

A liquid container that can present various information using illumination of a light-emitting unit includes an IC package having a storage element and the light-emitting unit. The storage element stores information used for controlling the amount of light emitted from an LED included in the light-emitting unit, so that variation in brightness of the light-emitting unit can be reduced and the information can be adequately presented.

4 Claims, 11 Drawing Sheets

INK CONTAINER WITH LIGHT-EMITTING UNIT TO CONVEY INFORMATION

BACKGROUND OF THE INVENTION

1. Field of the Invention

The present invention relates to liquid containers for storing liquid, such as ink, and recording apparatuses using the liquid containers. More particularly, the present invention relates to a liquid container that can present various information using illumination of a light-emitting unit, such as a light-emitting diode (LED), and a recording apparatus using the liquid container.

2. Description of the Related Art

Recently, as digital cameras have come into widespread use, a recording method called non-PC recording in which a digital camera is directly connected to a printer that serves as a recording apparatus to perform a recording operation without using a personal computer (PC) has become popular. In addition, another type of non-PC recording in which a card-shaped information storing medium for a digital camera is directly attached to a printer for data transmission to perform a recording operation has also become popular. On the other hand, an amount of ink remaining in an ink tank of a printer is generally checked on a monitor using a PC. Accordingly, in non-PC recording, there is a demand to check the amount of ink remaining in the ink tank without using a PC. If a user recognizes that there is only a small amount of ink remaining in the ink tank, the user can replace the ink tank with a new ink tank before starting the recording operation, so that recording failure due to ink shortage can be prevented in the recording operation.

A typical structure for informing the user of the state of the ink tank includes a display element, such as an LED. Japanese Patent Laid-Open No. 4-275156 discloses a structure including two LEDs on an ink tank that is integrated with a recording head. The two LEDs are turned on in two steps in accordance with the amount of remaining ink. Similarly, Japanese Patent Laid-Open No. 2002-301829 discloses a structure including a lamp that is turned on in accordance with the amount of remaining ink. In the structure according to Japanese Patent Laid-Open No. 2002-301829, each of four ink tanks used in a recording apparatus has the lamp for informing the user of the amount of remaining ink.

On the other hand, to satisfy the requirements to record images with higher quality, ink of low-density colors, such as light magenta and light cyan, is used in addition to ink of four colors (black, yellow, magenta, and cyan). In addition, special color ink like red ink and blue ink is also used. In such a case, many ink tanks (for example, seven or eight ink tanks) are individually mounted in a recording apparatus. Accordingly, a mechanism for preventing each ink tank from being mounted at a wrong position is necessary. U.S. Pat. No. 6,302,535 discloses a structure in which engagement portions between mounting units and corresponding ink tanks have different shapes so that each ink tank is prevented from being attached at a wrong position when the ink tank is mounted on a carriage.

In general, because of manufacturing variations, LEDs may emit different amounts of light even when all the LEDs are connected to the same circuit and the same amount of current is applied. Therefore, the amount of light emitted from the LEDs provided on the ink tanks may differ for each LED. For example, when the LEDs on the ink tanks blink to inform the user that the amount of remaining ink is low, some of the LEDs may emit bright light while other LEDs emit dark light. In such a case, there is a risk that the user will regard the difference in brightness as the difference between the states of the ink tanks. For example, the user may think that a relatively large amount of ink is remaining in the ink tanks with bright LEDs and a small amount of ink is remaining in the ink tanks with dark LEDs. Thus, if there is a variation in brightness between the LEDs on the ink tanks, the user may mistakenly recognize that the difference in brightness has a certain meaning. This degrades the function of informing the user of the amount of remaining ink.

A similar problem also occurs when light-emitting elements other than LEDs are used. For example, when a lamp is provided on each of a plurality of ink tanks, the amount of light emitted from the lamps may differ for each lamp due to differences in performance thereof. Also in this case, the differences in visual brightness more easily occur as the number of ink tanks increases.

SUMMARY OF THE INVENTION

The present invention is directed to a liquid container that can present various information using illumination of a light-emitting unit and that can reduce variations in brightness of the light-emitting unit so that the information can be adequately presented. The present invention is also directed to a recording apparatus including the liquid container.

According to one aspect of the present invention, a liquid container for storing liquid used in a recording apparatus includes an electrical contact facilitating electrical connection with the recording apparatus, a light-emitting unit that emits light on the basis of an input signal supplied through the electrical contact, and a storing unit that stores light amount information for controlling the amount of light emitted from the light-emitting unit.

According to one embodiment of the present invention, the liquid container includes a storing unit that stores the light amount information used for controlling the amount of light emitted from the light-emitting unit. The amount of light emitted from the light-emitting unit is controlled in each of a plurality of liquid containers, so that variation in brightness between the light-emitting units in the liquid containers can be reduced. As a result, the information can be adequately presented by each of the liquid containers.

Further features of the present invention will become apparent from the following description of exemplary embodiments with reference to the attached drawings.

DESCRIPTION OF THE EMBODIMENTS

Embodiments of the present invention will be described below with reference to the accompanying drawings.

First Embodiment

Figure 1A:
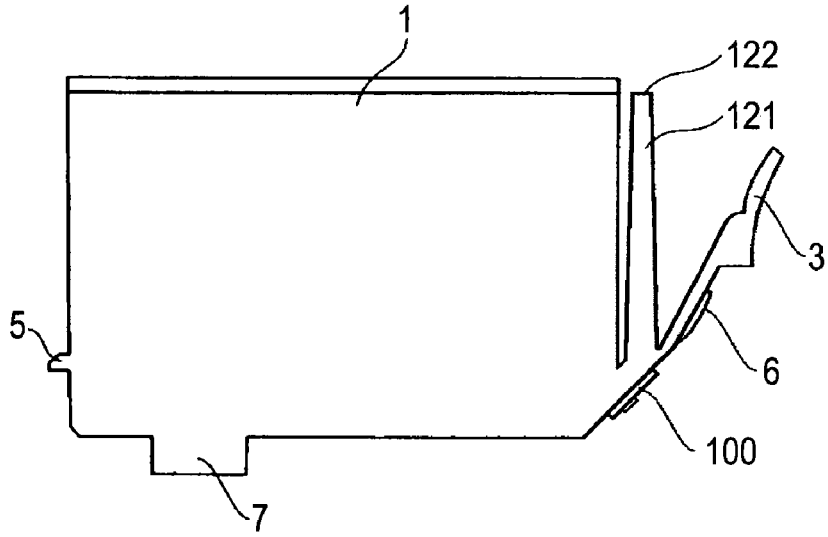
FIGS. 1A, 1B, and 1C are a side view, a front view, and a bottom view, respectively, of an ink tank according to a first embodiment of the present invention.
Figure 1B:
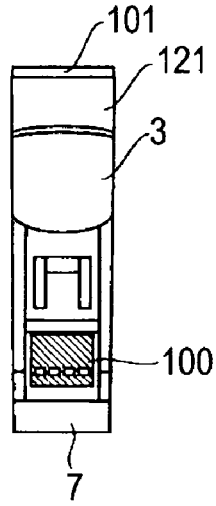
Figure 1C:
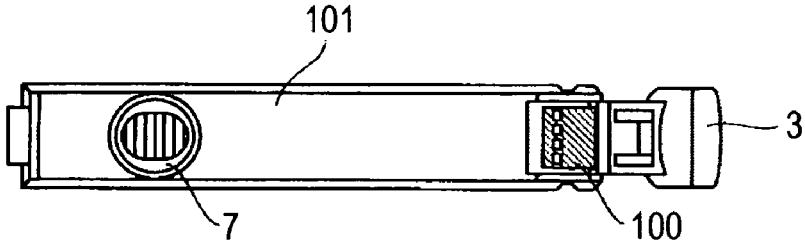

FIGS. 1A, 1B, and 1C are a side view, a front view, and a bottom view, respectively, of an ink tank that serves as a liquid container according to a first embodiment of the present invention. In the following description, a "front side" of the ink tank is defined as the side that faces a user to allow handling (e.g., attaching and detaching) of the ink tank and to provide information to the user (to emit light from a display unit, which will be described later).

Referring to FIGS. 1A, B, and C, an ink tank 1 of the present embodiment has a support member 3 that is supported on the front side of the ink tank 1 at a lower region thereof. The support member 3 is made of resin and is integrated with an outer casing of the ink tank 1. The support member 3 can be moved around the supporting portion when the ink tank 1 is attached to a tank holder, which will be described below. The ink tank 1 has a first engaging portion 5 and a second engaging portion 6 that is integrated with the support member 3 in the present embodiment on the back and front surfaces, respectively. The first and second engaging portions 5 and 6 become engaged with lock portions provided on the tank holder so that the ink tank 1 can be securely attached to the tank holder.

An ink supply hole 7 that combines with an ink inlet provided in a recording head, which will be described below, to supply ink when the ink tank 1 is attached to the tank holder, is provided in the bottom surface of the ink tank 1. A base member is provided on the bottom side of the supporting portion of the support member 3 at a position where the bottom and front sides of the ink tank 1 intersect. The base member may be chip-shaped or plate-shaped. In the following description, a substrate 100 is described as an example of the base member. Similar to the support member 3, a light guide member 121 made of resin is formed integrally with the outer casing of the ink tank 1 at a position between the support member 3 and the ink tank 1.

Figure 2A:
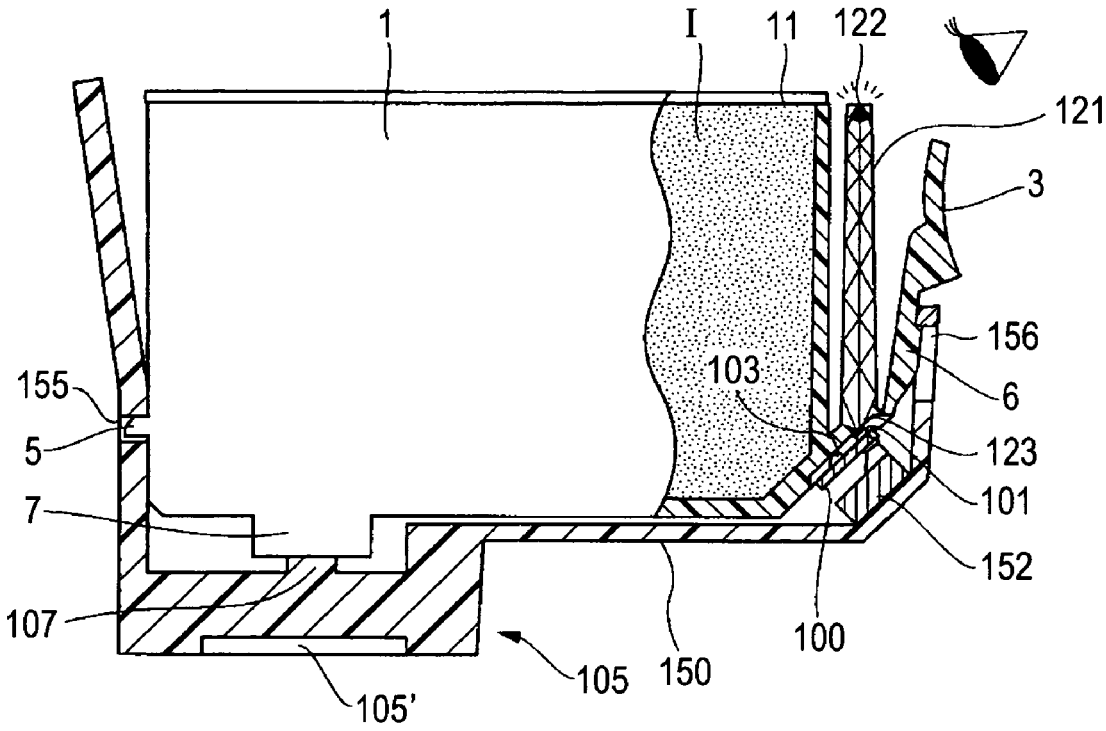
FIG. 2A is a schematic side view for explaining a function of a light guide member included in the ink tank shown in FIGS. 1A, 1B, and 1C.
Figure 2B:
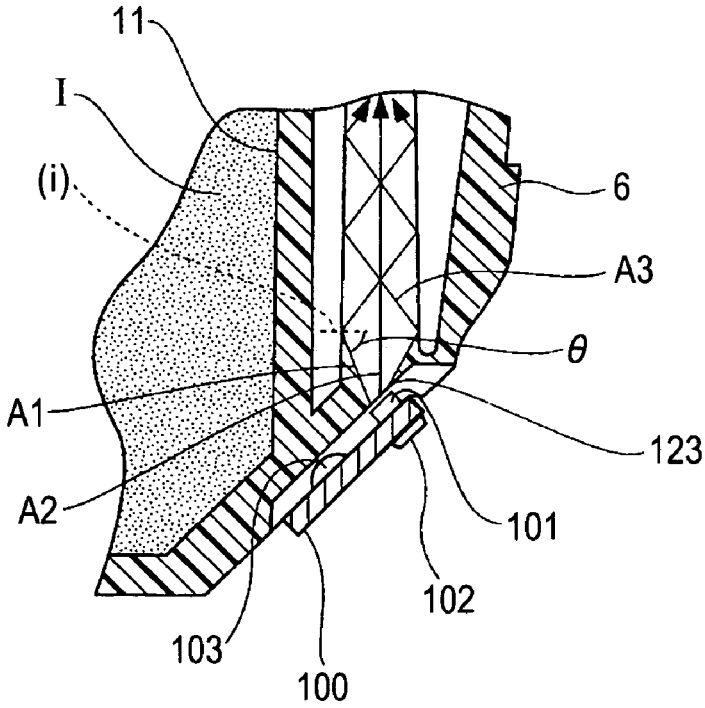
FIG. 2B is an enlarged view of the main portion of FIG. 2A.
Figure 3A:
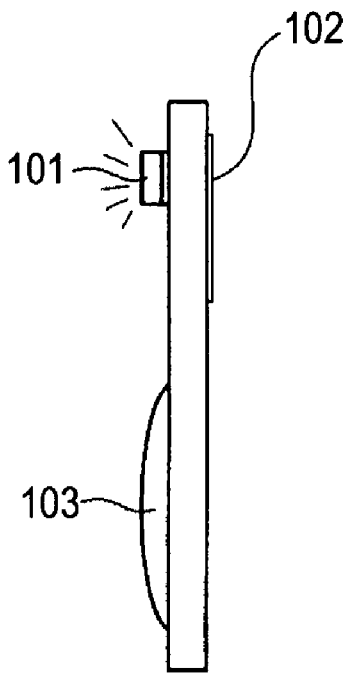
FIGS. 3A and 3B are a side view and a front view, respectively, illustrating an example of a substrate included in the ink tank shown in FIGS. 1A, 1B, and 1C.
Figure 3B:
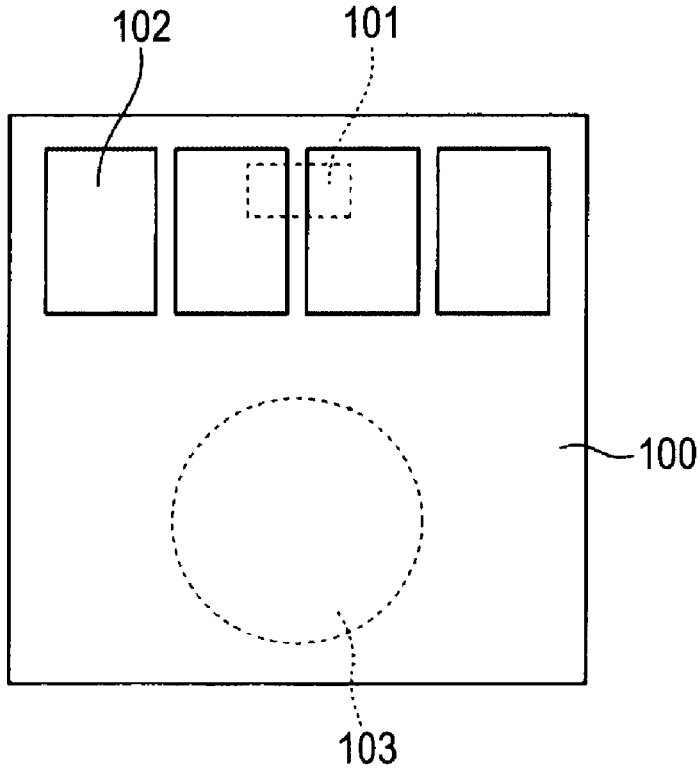

The structure and function of the main part of the present embodiment will be described below with reference to FIGS. 2A, 2B, 3A, and 3B. FIG. 2A is a schematic side view for explaining the function of the light guide member 121 included in the ink tank 1 according to the first embodiment of the present invention, and FIG. 2B is an enlarged view of the main portion of FIG. 2A. FIGS. 3A and 3B are a side view and a front view, respectively, illustrating an example of the control substrate 100 attached to the ink tank 1 according to the first embodiment.

Referring to FIG. 2A, a holder 150 that is integrated with a recording head unit 105 having a recording head 105' includes a first lock portion 155 and a second lock portion 156 that respectively engages with the first engaging portion 5 and the second engaging portion 6 of the ink tank 1. Accordingly, the ink tank 1 is securely attached to the holder 150. In this state, a contact 152 (hereafter called a connector) provided on the holder 150 comes into contact with electrode pads 102 (see FIG. 3B), which serve as contacts provided on an outwardly facing surface of the substrate 100 in the ink tank 1, to provide electrical connection.

The inside of the ink tank 1 is divided into an ink containing chamber 11 disposed adjacent to the front side and a negative-pressure-generator containing chamber (not shown) disposed adjacent to the back side. The negative-pressure-generator containing chamber communicates with the ink supply hole 7, and is connected to the ink containing chamber 11. Ink I is directly stored in the ink containing chamber 11, and an ink absorber (not shown) (hereafter called a porous member for convenience), such as a sponge and a fiber assembly that can be impregnated with ink is disposed in the negative-pressure-generator containing chamber. The porous member serves to apply a negative pressure to the ink, the negative pressure being sufficient to balance with a meniscus retaining force generated at nozzles of the recording head 105' for discharging ink, thereby preventing ink leakage from an ink discharge unit.

The recording head 105' may discharge ink by various ink discharging methods, such as those using electrothermal transducers (heaters) and piezoelectric elements. When electrothermal transducers are used, ink is vaporized using heat generated by the electrothermal transducers and ink drops are discharged from nozzles using the vaporization energy.

The internal structure of the ink tank 1 is not limited to the above-described structure including the chamber for storing the porous member and the member for directly storing ink. For example, the inside of the ink tank may be substantially entirely filled with the porous member. In addition, in place of the porous member, a bag-like member made of an elastic material, such as rubber, that generates a tension to increase the capacity thereof may also be used as a mechanism for generating the negative pressure. In such a case, the ink is directly stored in the bag-like member and the negative pressure is applied to ink by the tension generated by the bag-like member. In addition, an ink-containing space that is at least partially formed of a flexible material may be used. In such a case, the ink-containing space is filled only with ink and a negative pressure is generated by applying a spring force to the flexible material.

As shown in FIGS. 3A and 3B, a light-emitting unit 101 including a light-emitting element, such as an LED, for emitting visible light, a storage element that stores information which will be described below, and a control element configured to control the light-emitting unit 101 are provided on an inwardly facing surface of the control substrate 100 included in the ink tank 1. In the present embodiment, the storage element and the control element are integrated into an IC package 103 provided on the substrate 100.

The IC package 103 receives an electrical signal from the connector 152 through the pads 102, and the control element controls the illumination of the light-emitting unit 101 in accordance with the electrical signal. To suppress the reduction in the amount of light when light emitted from the light-emitting unit 101 enters the light guide member 121, the substrate 100 is disposed such that the light-emitting unit 101 is positioned near a light entrance surface 123 of the light guide member 121.

As shown in FIG. 2B, light emitted from the light-emitting unit 101 enters the light guide member 121 through the light entrance surface 123 provided at an end face of the light guide member 121, passes through the light guide member 121, and reaches a display unit 122 that presents the light to the user. As described above, the light-emitting unit 101 emits visible light, which is diffused so that a plurality of light rays A1 to A3 is generated.

In the present embodiment, the outer casing of the ink tank 1 is made of polypropylene. Since the light guide member 121 is integrated with the outer casing of the ink tank 1, the light guide member 121 is also made of polypropylene. The refractive index of polypropylene is 1.49, and that of air is 1.00. Accordingly, the critical angle of refraction at the boundary between polypropylene and air is determined to be about 43° from Snell's law of refraction, which is expressed as follows:

$$n1 \cdot \sin \theta 1 = n2 \cdot \sin \theta 2$$

Therefore, light rays with an incidence angle θ of 43° or more at the point (i) shown in FIG. 2B are totally reflected at the boundary between polypropylene (light guide member 121) and air, and reaches the display unit 122 after repeating the total reflection in the light guide member 121, as shown by the arrows A1 and A3. In addition, light rays with an incidence angle θ of less than 43° are transmitted into the air and do not reach the display unit 122.

As described above, the light-emitting unit 101 and the display unit 122 are separated from each other and the light guide member 121 that optically connects the light-emitting unit 101 with the display unit 122 is provided in the ink tank 1. Thus, a structure that allows the arrangement of the light-emitting unit 101 and the display unit 122 at optimum positions without the use of wiring for power supply or signal communication, which degrades the visibility and operability, can be provided at a low cost. Accordingly, the display unit 122 can be disposed with freedom at a position where the visibility for the user is ensured. The user can visually check the state of illumination of the display unit 122 and recognize the information (for example, information regarding the ink tank 1) corresponding to the state of illumination. In addition, since the light guide member 121 is integrated with the outer casing of the ink tank 1, a large increase in the manufacturing cost is prevented.

The information of the ink tank 1 corresponding to the state of illumination of the display unit 122 may be, for example, information regarding the attachment state of the ink tank 1, the attachment position of the ink tank 1, or the amount of remaining ink. The information can be presented by controlling the on/off state of the illumination of the light-emitting unit 122 or the manner in which the display unit 122 is illuminated (blinking, etc.) The information regarding the attachment state of the ink tank 1 shows whether or not the ink tank 1 is completely attached. The information regarding the attachment position of the ink tank 1 shows whether or not the ink tank 1 is attached at a proper attachment position on the holder, for example, at an attachment position determined in correspondence with the color of ink contained in the ink tank 1. The information regarding the amount of remaining ink shows whether or not a sufficient amount of ink remains in the ink tank 1.

When the ink tank 1 is manufactured, an illumination confirmation process for the light-emitting unit 101 is performed and the amount of light emitted by the light-emitting unit 101 is checked at the same time. The amount of light emitted is determined by detecting the intensity of light that travels from the light-emitting unit 101 to the display unit 122 through the light guide member 121 with a sensor. Then, information corresponding to the detected intensity is stored in the storage element included in the IC package 103. For example, the intensity of light output from the display unit 122 is classified into four ranks, and information corresponding to one of the four ranks is stored in the storage element in the IC package 103. At the same time, other information such as the color of ink contained in the ink tank 1 (color ID that serves as individual information of the liquid container), an individual code that differs for each ink tank 1, the date on which the ink tank 1 was filled with ink, and the amount of ink supplied to the ink tank 1, is also stored in the storage element.

Figure 4:
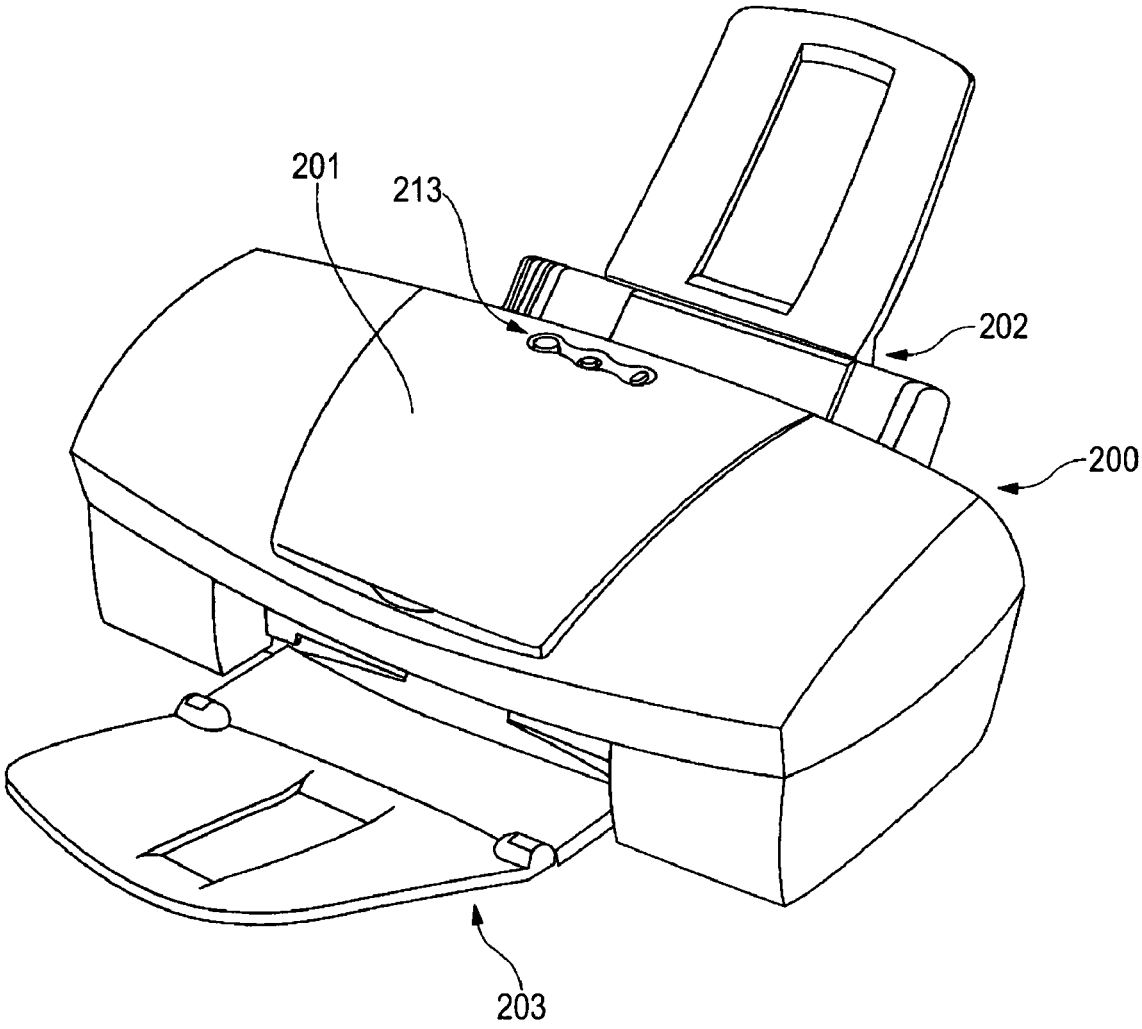
FIG. 4 is a perspective view of an inkjet printer to which the ink tank can be attached.
Figure 5:
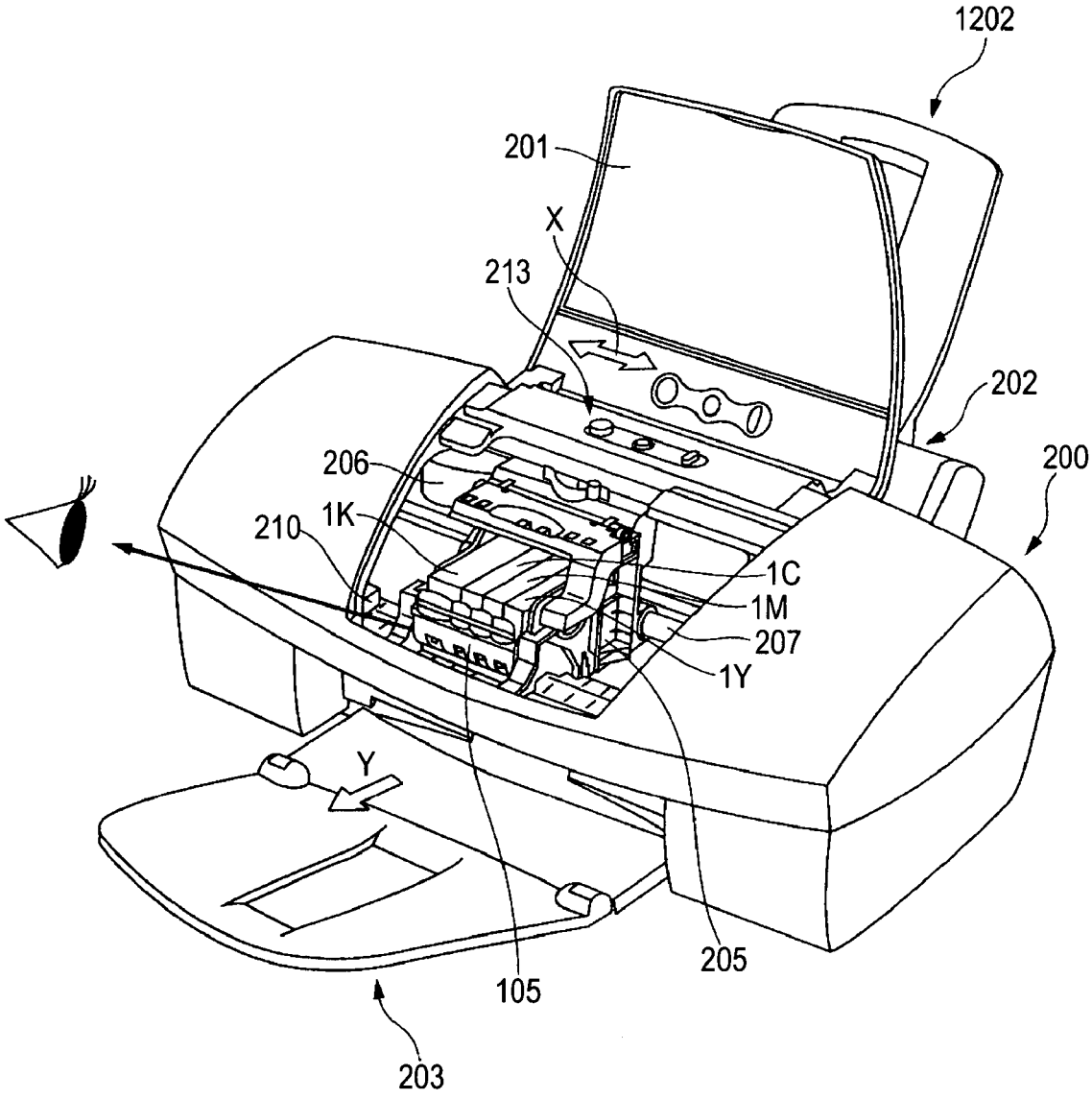
FIG. 5 is a perspective view of the inkjet printer shown in FIG. 4 in a state in which a main cover of the inkjet printer is opened.

FIG. 4 is a perspective view of an inkjet printer 200 to which ink tanks similar to the above-described ink tank can be attached to perform a recording operation. FIG. 5 is a perspective view of the inkjet printer 200 shown in FIG. 4 in a state in which a main cover 201 is opened. The inkjet printer 200 according to the present embodiment can receive ink tanks 1K, 1Y, 1M, and 1C containing black (K) ink, yellow (Y) ink, magenta (M) ink, and cyan (C) ink, respectively.

As shown in FIG. 4, the printer 200 according to the present embodiment includes a printer main body, a paper output tray 203 disposed at the front side of the printer main body, and an automatic sheet feeder (ASF) 202 disposed at the back side of the printer main body. The printer main body has a main part including a mechanism for moving a carriage on which recording heads and the ink tanks are mounted in the recording operation, and the main part is covered with a main-body cover 201 and other casing portions. The printer main body is also provided with an operating unit 213 including a display device that displays the state of the printer 200 both when the main-body cover 201 is open and closed, a power switch, and a reset switch.

As shown in FIG. 5, when the main-body cover 201 is open, the user can see the movable range of a carriage 205 that carries a recording head unit 105 and the ink tanks 1K, 1Y, 1M and 1C and a region around the movable range. In the following description, the ink tanks may simply be denoted by 1 for simplicity. When the main-body cover 201 is opened, a sequence for automatically moving the carriage 205 to a substantially central position (hereafter also called a tank replacing position), as shown in the figure, is executed. The user can replace each ink tank 1 with a new ink tank when the carriage 205 is at the tank replacing position.

In the inkjet printer 200 according to the present embodiment, the recording head unit 105 includes chip-type recording heads 105' corresponding to respective colors of ink. The recording heads 105' scan a recording medium, such as a sheet of paper, as the carriage 205 moves in the direction shown by the arrow X. The recording operation is performed by discharging ink towards the recording medium while the recording medium is being scanned. More specifically, the carriage 205 is slidably engaged with a guiding shaft 207 that extends in the moving direction of the carriage 205, and is moved in the main scanning direction shown by the arrow X by a carriage motor and a transmission mechanism thereof. The recording heads 105' corresponding to the black (K) ink, the yellow (Y) ink, the magenta (M) ink, and the cyan (C) ink discharge ink on the basis of discharge data transmitted from a control circuit in the printer main body via a flexible cable 206. The recording medium (not shown) fed by the automatic sheet feeder 202 is conveyed to the paper output tray 203 by a paper conveying mechanism including conveying rollers and paper-output rollers. The recording head unit 105 including ink tank holders is detachably attached to the carriage 205. In addition, as described above, the ink tanks 1 are detachably attached to the recording head unit 105.

In the recording operation, the recording heads 105' eject ink towards the recording medium while moving in the main scanning direction, so that recording is performed in a region with an effective width that corresponds to a nozzle arrangement area of the recording heads 105' (arrangement area of nozzles in a direction perpendicular to the main scanning direction). Then, before main scanning of the next cycle is started, the paper conveying mechanism conveys the recording medium in a sub-scanning direction shown by the arrow Y by a distance corresponding to or smaller than the above-mentioned effective width. These processes are repeated to successively record images on the recording medium. A recovery unit (not shown) including a cap for covering a nozzle surface of each recording head 105' is provided at an end of the moving area of the recording heads 105' that move together with the carriage 205. The recording heads 105' are moved to the position where the recovery unit is provided at every predetermined time interval, and a recovery process, such as preliminary discharge, is performed.

The recording head unit 105 has the tank holder 150 for each ink tank 1, and is provided with connectors 152 corresponding to the respective ink tanks 1, as described above. Each of the contactors 152 is in contact with and electrically connected to pads 102 provided on the corresponding ink tank 1 that is attached to the tank holder 150. Accordingly, the light-emitting unit 101 included in each ink tank 1 is illuminated or caused to blink on the basis of a predetermined sequence executed by the recording apparatus. Thus, the information regarding the state of each ink tank 1 is presented using the illumination of the corresponding light-emitting unit 101.

More particularly, at the above-described tank replacing position, the light-emitting unit 101 of each ink tank 1 is illuminated or caused to blink when, for example, the amount of ink remaining in the ink tank 1 becomes small. The light from the light-emitting unit 101 is guided to the display unit 122 through the light guide member 121 so that the display unit 122 emits continuous or intermittent light that can be viewed by the user. Alternatively, the light-emitting unit 101 may also be turned on when the corresponding ink tank 1 is properly attached at a predetermined position while the carriage 205 is at the tank replacing position. In such a case, light from the light-emitting unit 101 is guided to the display unit 122 through the light guide member 121 so that the display unit 122 emits continuous light that can be viewed by the user. Similar to the ink discharge control of the recording heads 105', the light-emitting unit 101 in each ink tank 1 is controlled by transmitting control data (control signal) to the ink tank 1 from the control circuit in the printer main body via the flexible cable 206.

Figure 6:
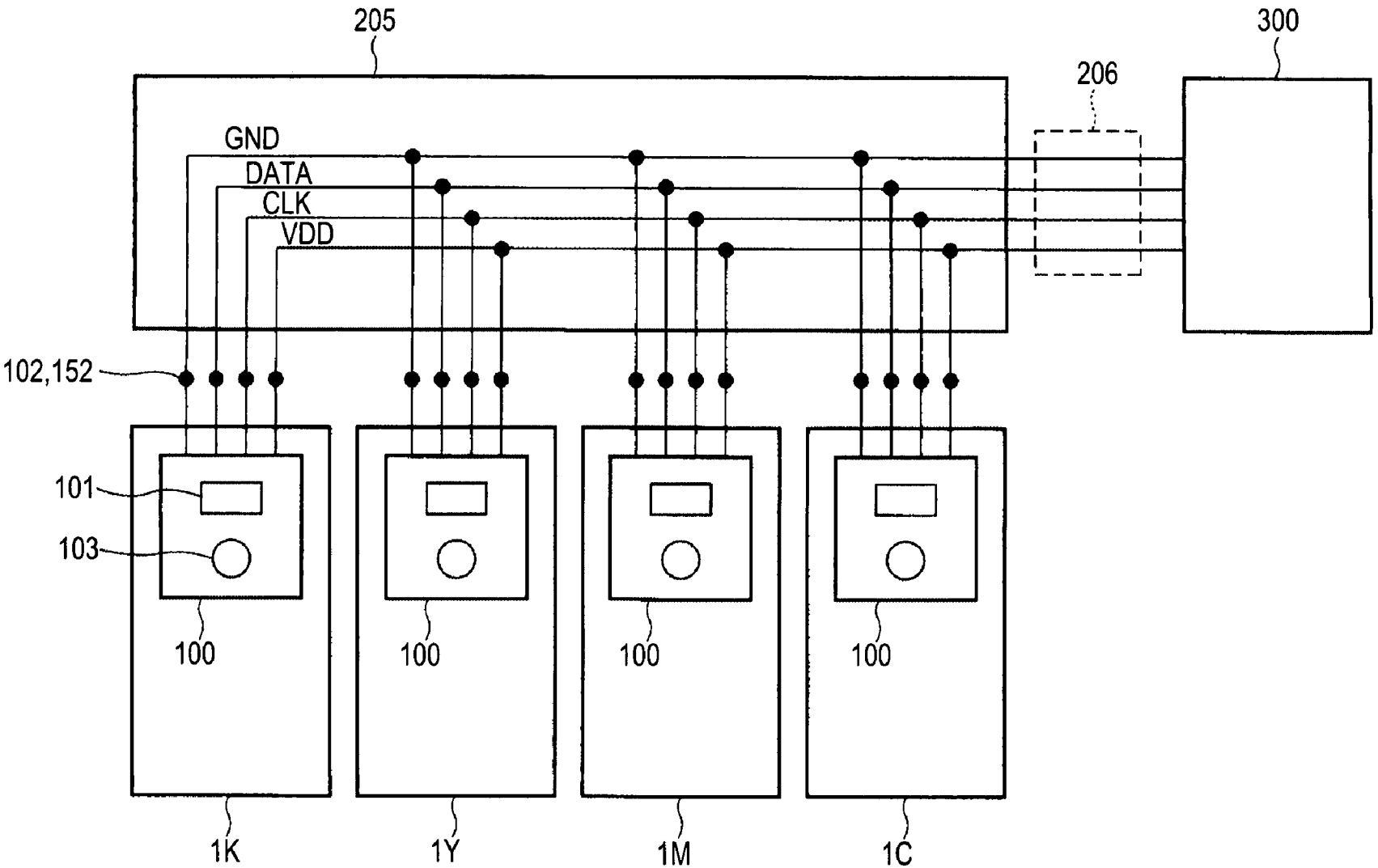
FIG. 6 is a diagram illustrating an example of a structure of signal wiring between the inkjet printer shown in FIG. 4 and ink tanks.

FIG. 6 is a diagram illustrating an example of signal wiring between a control circuit 300 in the printer main body and the control substrates 100 in the ink tanks 1.

The signal wiring according to the present embodiment includes signal lines that are common to all of four ink tanks 1 (bus connection). The four signal lines for the ink tanks 1 include a source signal line 'VDD', a ground signal line 'GND', a control signal line 'DATA', and a clock signal line 'CLK'. The source signal line 'VDD' and the ground signal line 'GND' are used for supplying power to functional elements included in the IC packages 103 that drive the light-emitting units 101 in the ink tanks 1. The control signal line 'DATA' transmits a control signal (control data) used for illuminating the light-emitting units 101 or causing the light-emitting units 101 to blink to the IC packages 103 from the control circuit 300, as will be described below. The clock signal line 'CLK' transmits a clock signal for the control signal.

In the present embodiment, the structure including the four signal lines will be described. However, the number of signal lines is not limited to four. For example, the ground signal line 'GND' may be omitted by transmitting the ground signal using another structure. In addition, the signal lines 'CLK' and 'DATA' may be integrated into a single line. In such a case, it is not necessary to provide the signal line 'DATA' to each ink tank 1, and the number of lines in the flexible cable 206 can be reduced.

The bus connection used in the present embodiment is effective in reducing costs in printers having many ink tanks 1. For comparison, a printer having eight ink tanks 1 for eight colors in which a signal line 'DATA' is provided for each ink tank 1 will be considered. In this structure, eight signal lines 'DATA' for the eight ink tanks 1 and a power signal line 'VDD', a ground signal line 'GND', and a clock signal line 'CLK' common to the eight ink tanks 1 are required. Accordingly, eleven signal lines are required in total, which leads to complex wiring in the flexible cable 206. As a result, the cost is increased. In contrast, in the bus connection of the present embodiment, the number of signal lines is four irrespective of the number of ink tanks 1 mounted. Accordingly, the bus connection of the present embodiment is advantages in printers having many ink tanks for different colors.

As described above, the control substrate 100 in each ink tank 1 includes the IC package 103 driven by signals transmitted via the four signal lines and the light-emitting unit 101 controlled by the IC package 103.

Figure 7:
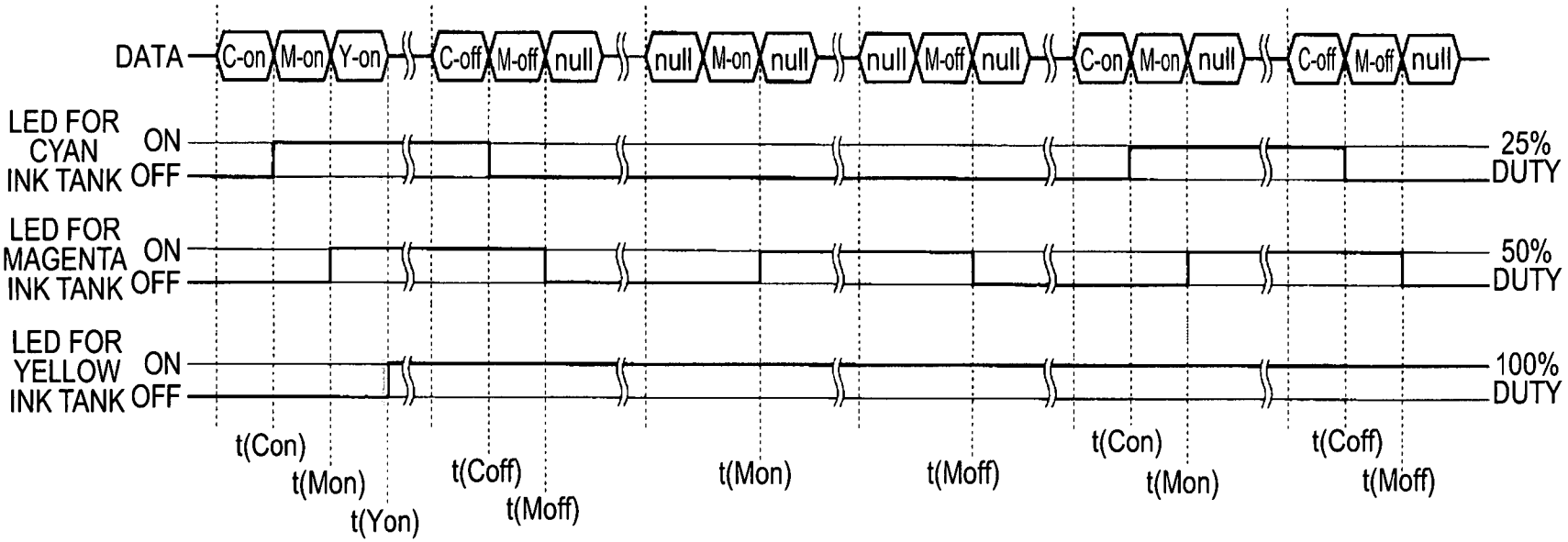
FIG. 7 is a diagram illustrating light emission timing of light-emitting units of the ink tanks included in the inkjet printer shown in FIG. 4.

FIG. 7 is a schematic diagram of a timing chart showing the relationship between packets transmitted from the control circuit 300 in the printer main body to the signal line 'DATA' and light emission timing of the LEDs (light-emitting elements) in the light-emitting units 101 included in the ink tanks 1. As described above, four ink tanks 1 for four colors of ink are mounted on the printer according to the present embodiment. However, to facilitate understanding, a structure including three ink tanks 1 (1Y, 1M, and 1C) for yellow (Y), magenta (M), and cyan (C) ink are will be described below.

Each packet transmitted from the control circuit 300 of the printer includes a color ID that designates one of the three ink tanks 1 and a signal for controlling the on/off state of the LED of the light-emitting unit 101 in the designated ink tank 1. More specifically, 'DATA' shown in FIG. 7 includes packets 'C-on', 'M-on', and 'Y-on' from the left in the figure. In these packets, 'C', 'M', and 'Y' are color IDs and 'on' attached to the color IDs is the 'on' signal for the corresponding LEDs. These packets in 'DATA' serve as commands for turning on the light-emitting units 101 included in the ink tank 1C for the cyan ink, the ink tank 1M for the magenta ink, and the ink tank 1Y for the yellow ink. In addition, the following packets 'C-off' and 'M-off' in 'DATA' serve as commands for turning off the light-emitting units 101 in the ink tanks 1C and 1M. In these packets, 'C' and 'M' are color IDs and 'off' attached to the color IDs is the 'off' signal for the corresponding LEDs. In FIG. 7, 'null' shows that there is no signal to be provided.

When the control element in the IC package 103 included in each ink tank 101 receives a packet that serves as a command as described above, the control element compares the color ID stored in the storage element in the IC package 103 with the color ID included in the packet. When the two color IDs do not match, the control element ignores the on/off command attached to the color ID in the packet. In contrast, when the two color IDs match, the control element responds to the on/off command attached to the color ID in the packet. For example, when the packet in 'DATA' is 'C-on', the control element in the IC package 103 of the ink tank 1C for cyan ink responds to the command and turns on the light-emitting unit 101 in the IC package 103. In contrast, the control elements in the IC packages 103 of the other ink tanks 1M and 1Y do not respond to that command. Thus, each of the light-emitting units 101 in the ink tanks 1 can be individually turned on and off via the bus connection.

In FIG. 7, t(Con) and t(Coff) show the times when the light-emitting unit 101 in the ink tank 1C is turned on and off in response to the packets 'C-on' and 'C-off'. In addition, t(Mon) and t(Moff) show the times when the light-emitting unit 101 in the ink tank 1M is turned on and off in response to the packets 'M-on' and 'M-off', and t(Yon) shows the time when the light-emitting unit 101 in the ink tank 1Y is turned on in response to the packet 'Y-on'. The time when the light-emitting unit 101 in the ink tank 1Y is turned off is expressed as t(Yon), although not shown in FIG. 7.

Because of manufacturing variations, the LEDs that function as light emitting elements in the light-emitting units 101 may emit different amounts of light even when all the LEDs are connected to the same circuit and the same amount of current is applied. Therefore, the amount of light emitted from the light-emitting units 101 in the ink tanks 1 may differ for each ink tank 1. In addition, the light guide members 121 may also have individual differences in light-guiding performance due to manufacturing variations, and there is a risk that the amount of light guided by the light guide members 121 will be reduced. As a result, a large variation may occur in the amount of light guided by the display units 122.

In the present embodiment, the control circuit 300 in the printer main body controls the amount of light emitted from each light-emitting unit 101 per unit time on the basis of the light-amount rank information stored in the storage element of the corresponding IC package 103, that is, the rank information in which the intensity of light output from the corresponding display unit 122 is classified into four ranks. More specifically, for the ink tank 1 that emits light with high intensity from the display unit 122, the width of the driving pulse signal for illuminating the LED in the ink tank 1 is reduced. In contrast, for the ink tank 1 that emits light with low intensity from the display unit 122, the width of the driving pulse signal for illuminating the LED in the ink tank 1 is increased. Accordingly, the variation in brightness between the display units 122 in the ink tanks 1 can be reduced.

To control the brightness of each display unit 122 with the control circuit 300, the IC package 103 provided in each ink tank 1 has a function of transmitting the light-amount rank information to the control circuit 300 together with the color ID thereof. When the control circuit 300 receives the color ID and the light-amount rank information, the control circuit 300 reduces the brightness of the LEDs in the ink tanks 1 with high ranks, that is, the ink tanks 1 having bright display units 122, by increasing the intervals of 'on' time and 'off' time for the corresponding LEDs. For this purpose, the control circuit 300 generates, for example, 'DATA' shown in FIG. 7 in accordance with the light-amount rank information. In this case, the control element in the ink tank 1C generates a driving pulse signal with an illumination duty of 25% for the corresponding LED and the control element in the ink tank 1M generates a driving pulse signal with an illumination duty of 50% for the corresponding LED on the basis of 'DATA'.

The driving pulse signal has a duty of 100% when it is continuously set to 'on'. The duty of the driving pulse signal is 50% when the 'on' time is half the time unit in which 'on' and 'off' are repeated, and is 25% when the 'on' time is quarter of the time unit in which 'on' and 'off' are repeated. For example, when a time interval in which the pulse signal is set to 'on' is constant, the duty can be set in terms of the frequency at which the driving pulse signal is switched to 'on' within a time unit. When the illumination duty of the LEDs is reduced to 25%, 50%, etc., on the basis of the thus modulated driving pulse signal, the LEDs can be darkened when viewed by human eyes.

The control circuit 300 increases the brightness of the LEDs in the ink tanks 1 with low ranks, that is, the ink tanks 1 having dark display units 122. For this purpose, the control circuit 300 generates, for example, 'DATA' in FIG. 7 in accordance with the light-amount rank information. Accordingly, the control element in the ink tank 1Y generates a driving pulse signal with a maximum illumination duty of 100% for the corresponding LED and thereby continuously illuminates the LED. Thus, the brightness of the LED is at a maximum brightness when viewed by human eyes.

In general, when there is a light-emitting element, such as an LED, that is twice as bright as a normal light-emitting element, the brightness of that light-emitting element can be reduced to a normal level by setting the illumination duty to 50%. Accordingly, by associating the light-amount rank information with the illumination duty, the variation in brightness between the display units 122 of the ink tanks 1 can be reduced. The blinking of the light-emitting elements such as LEDs caused by setting the illumination duty is generally recognized as a flicker by human eyes when the frequency is 50 Hz or less. Therefore, the illumination duty can be set at the frequency of blinking is 100 Hz or more, for example.

Figure 8A:
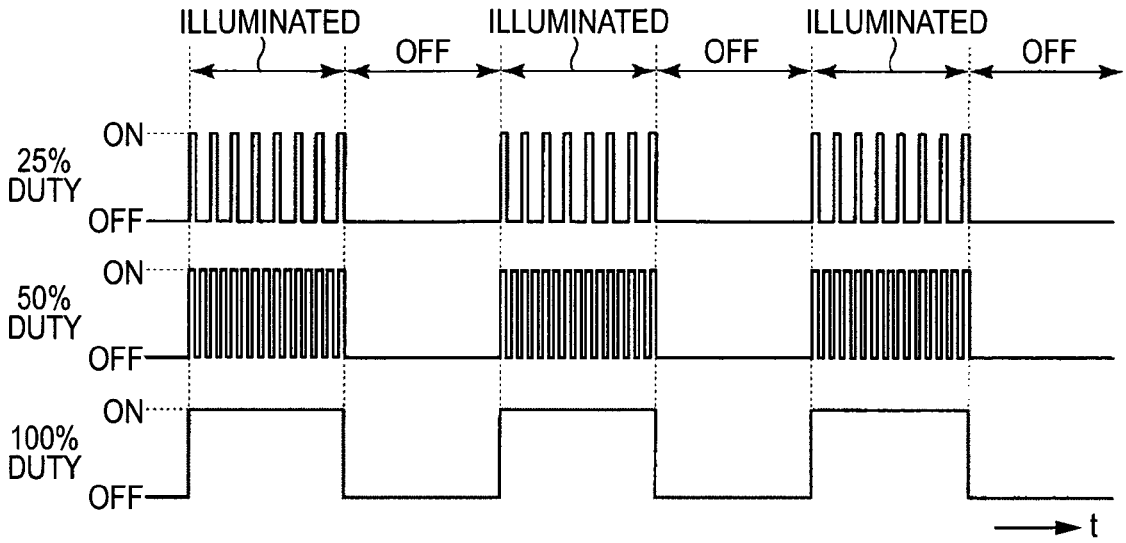
FIGS. 8A and 8B are diagrams illustrating illumination patterns for the light-emitting units of the ink tanks.
Figure 8B:
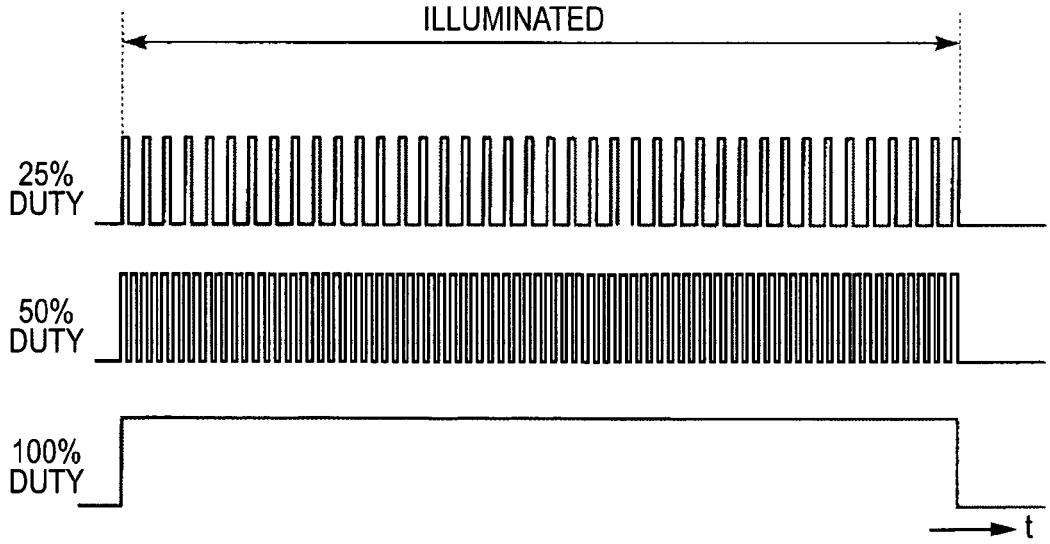

FIGS. 8A and 8B are timing charts showing illumination patterns of LEDs that function as light-emitting elements.

FIG. 8A illustrates examples of illumination patterns with which the user can visually recognize that the LED is blinking. Referring to FIG. 8A, the repetition of the illuminated period and the off period is recognized as blinking light. FIG. 7 corresponds to a part of the illumination period in FIG. 8A. FIG. 8B illustrates examples of illumination patterns with which the user can visually recognize that the LED is continuously illuminated. FIG. 7 corresponds to a part of the illumination period in FIG. 8A. In FIGS. 8A and 8B, the illumination duty is set to 25%, 50%, and 100%, in that order from the top. The LED is turned on and off as shown in FIG. 7 at a frequency (100 Hz or more) higher than the repetition frequency of the illumination period and the off period in FIG. 8A, so that the visual brightness can be controlled (the LED is not turned on and off when the duty is 100% since the LED is continuously turned on).

In addition, the display unit 122 can be shown to the user such that the display unit 122 is either blinking or continuously illuminated by combining the illumination patterns shown in FIGS. 8A and 8B. Also in this case, the variation in the brightness of the display unit 122 between the ink tanks 1 can be reduced and the information regarding each ink tank 1 can be properly displayed.

In the present embodiment, each ink tank 1 is provided with the light guide member 121 that guides light to the display unit 122 to present the light to the user. However, the light-emitting element may also be arranged such that the user can directly view the light-emitting element. In such a case, the variation between the light guide members 121 can be omitted. Accordingly, the light-amount rank information depends on the variation in the amount of light emitted from the light-emitting elements.

Second Embodiment

In the above-described first embodiment, the control circuit 300 in the printer main body controls the illumination of the LEDs (light-emitting elements) to present the information regarding the amount of ink remaining in each ink tank 1 or the like to the user. In addition, the control circuit 300 also performs a control process for reducing the variation in the amount of light emitted from the LEDs on the basis of the light-amount rank information stored in each ink tank 1. However, the control process for reducing the variation in the amount of light can also be performed by the control element in the IC package 103 included in each ink tank 1.

In the second embodiment according to the present invention, the control element in the IC package 103 included in each ink tank 1 performs the control process for reducing the variation in the amount of light emitted from the LEDs on the basis of the light-amount rank information stored in the storage element in the IC package 103.

Figure 9:
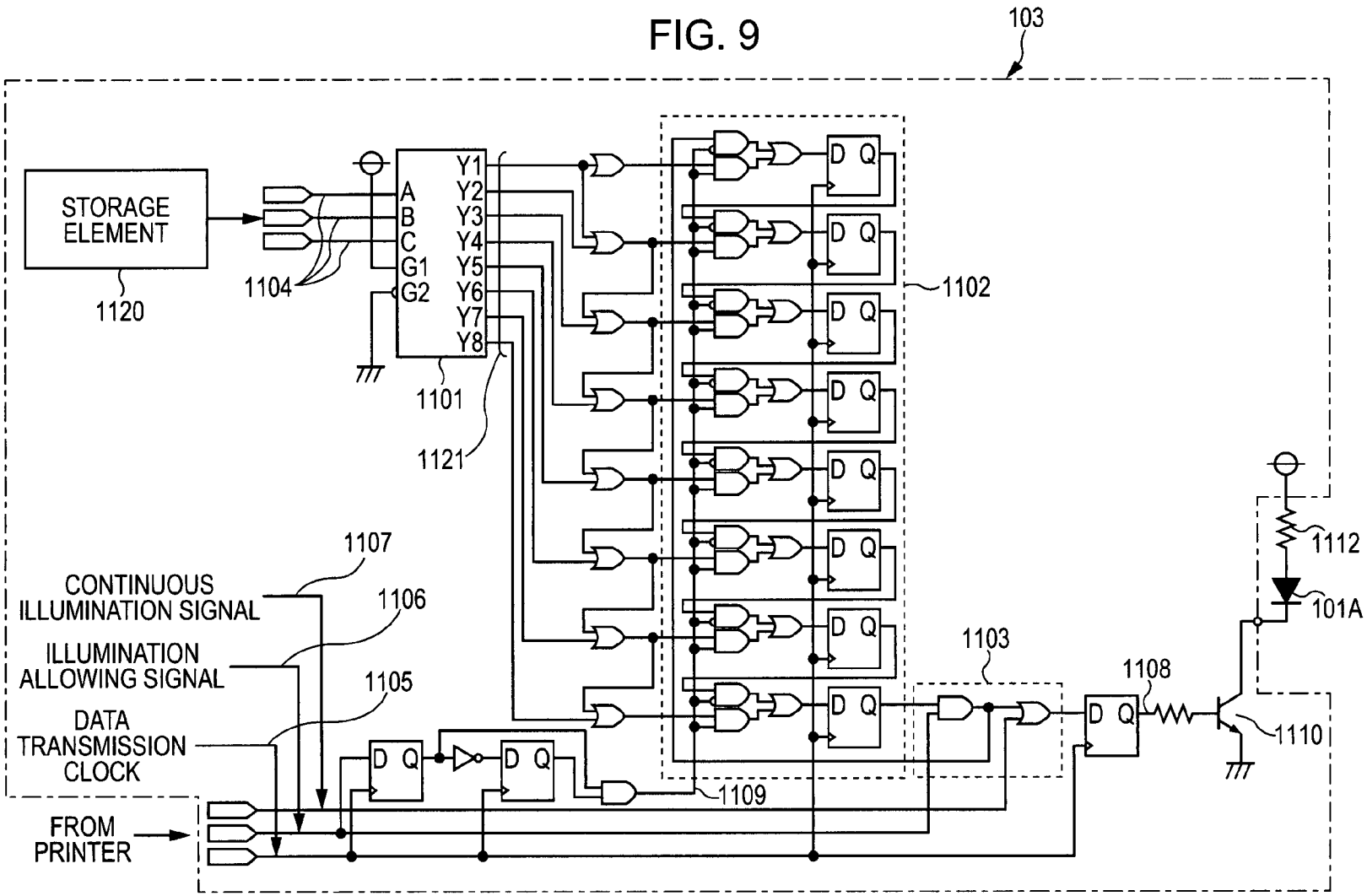
FIG. 9 is a circuit diagram of an IC package of an ink tank according to a second embodiment of the present invention.

FIG. 9 is a diagram illustrating an example of a circuit structure of the IC package 103 included in each ink tank 1 that shows the feature of the second embodiment of the present invention. Similar to the first embodiment, a power line and a ground line of the circuit in the IC package 103 are connected to the printer main body so that the power can be supplied therefrom.

Referring to FIG. 9, the circuit includes a decoder 1101, a shift register 1102, and an output controller 1103. Light-amount rank data (rank information) 1104 is stored in the storage element (information storing unit) 1120 included in the IC package 103. A data transmission clock 1105 is supplied from the printer main body, and is used in common by the information storing unit 1120. An illumination allowing signal 1106 and a continuous illumination signal 1107 are also supplied from the printer main body. A driving signal 1108 is used for illuminating an LED 101A included in the light-emitting unit 101, and a load signal 1109 is used for setting data decoded in the shift register 1102. A transistor 1110 is switched on and off in accordance with the LED driving signal 1108, and the LED 101A functions as the light-emitting element in the light-emitting unit 101. A current limiting resistor 1112 for the LED 101A is mounted on the exterior of the IC package 103 or is disposed in the IC package 103.

Figure 10:
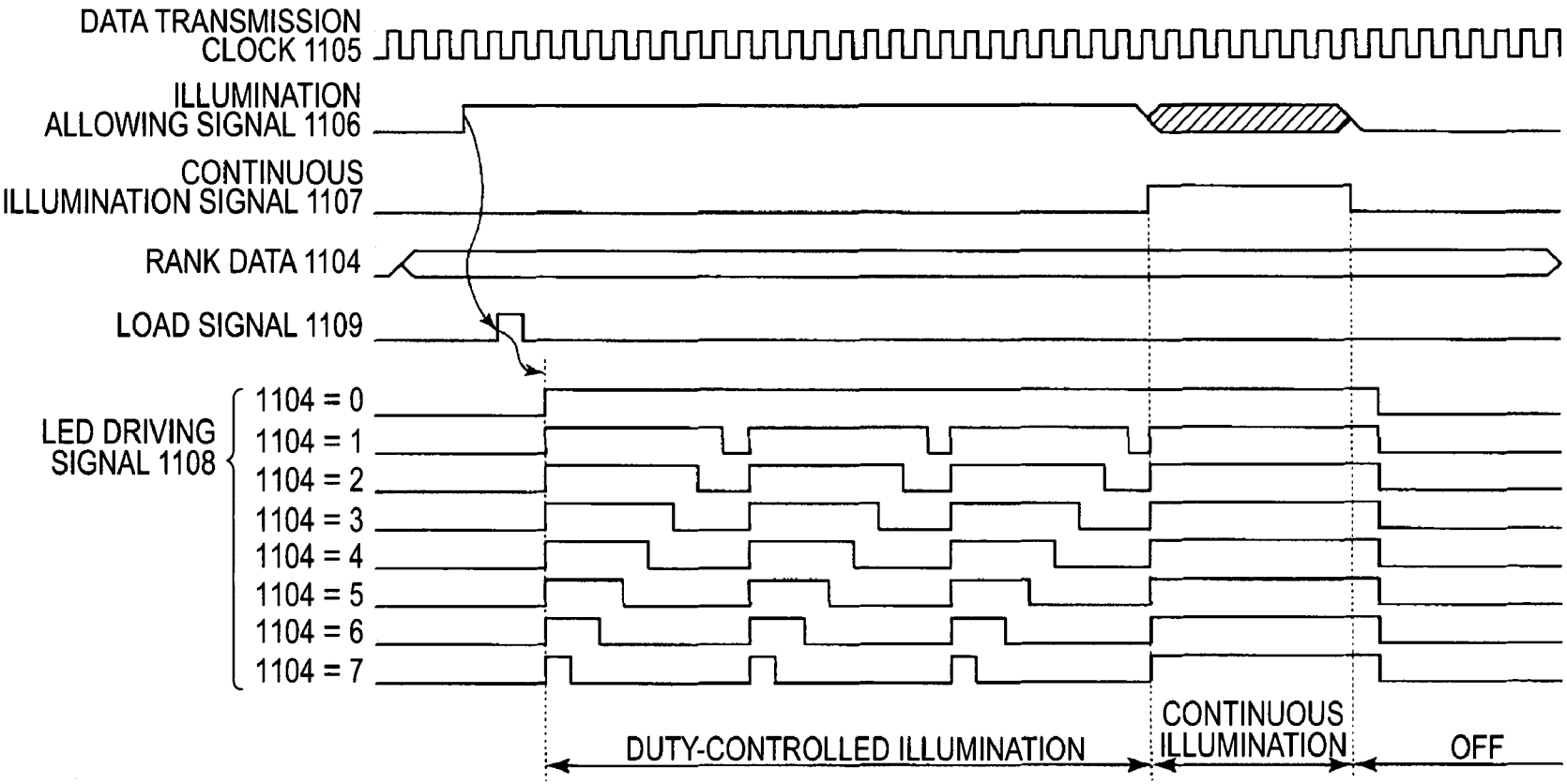
FIG. 10 is a diagram illustrating light emission timing of an LED shown in FIG. 9.

FIG. 10 is a timing chart applied when the circuit having the structure shown in FIG. 9 is driven.

The data transmission clock 1105 is continuously supplied to a plurality of ink tanks 1 connected by bus connection. An operation of reading from and writing on the storage element 1120 and transmission of a command for turning on or off the LED 101A are performed in synchronization with the data transmission clock 1105. The light-amount rank data 1104 is decoded by the decoder 1101 so that a duty control signal 1121 is obtained. According to the present embodiment, the light-amount rank data 1104 represents one of eight ranks with three bits, where '000' corresponds to the lowest brightness and '111' corresponds to the highest brightness.

When the illumination allowing signal 1106 is set to high (H) level, the load signal 1109 is switched to H level for a width corresponding to a single period of the data transmission clock 105 and is input to the shift register 1102. When the load signal 1109 is set to H level, the duty control signal 1121 is set in a flip-flop in the shift register 1102. After the duty control signal 1121 is set, the signal is successively transmitted through flip-flops in the shift register 1102, and is input to the output controller 1103 as serial data. Then, the AND process of the serial data and the illumination allowing signal 1106 is performed, and the output is fed back to the serial input of the shift register 1102. Then, the shift register 1102 continuously outputs a signal having a pattern depending on the rank information corresponding to one of eight ranks (0 to 7) represented by the rank data 1104. Accordingly, as shown in FIG. 10, the LED driving signal 1108 corresponding to one of the eight ranks (0 to 7) is generated on the basis of the signal output from the shift register 1102.

The transistor 1110 is connected to a cathode terminal of the LED 101A and the power source is connected to an anode terminal of the LED 101A with the resistor 1112 provided therebetween. Accordingly, the LED 101A can be illuminated in accordance with the LED driving signal 1108. The transistor 1110 may be disposed outside the chip of the IC package 103, and the power source of the LED 101A is not necessarily the same as that of the logic system. When the LED driving signal 1108 is at the H level, the transistor 1110 is turned on and a current is applied to the LED 101A, so that the LED 101A is illuminated. When the LED driving signal 1108 is at the L level, the transistor 1110 is turned off and the LED 101A is not illuminated.

Thus, the LED 101A is repeatedly turned on and off at a high speed in accordance with the rank information representing one of the eight ranks (0 to 7), so that the brightness recognized by the user can be controlled. More specifically, similar to the first embodiment, the illumination duty of the LED 101A is increased when the display unit 122 of the corresponding ink tank 1 is dark, that is, when the rank information of corresponding ink tank 1 represents a low rank. On the other hand, the illumination duty of the LED 101A is reduced when the display unit 122 of the corresponding ink tank 1 is bright, that is, when the rank information of corresponding ink tank 1 represents a high rank. Thus, the illumination duty of the LED 101A is controlled on the basis of the LED driving signal 1108 corresponding to the rank information. Accordingly, similar to the first embodiment, the brightness at the display unit 122 is constant in all the ink tanks 1. In the present embodiment, when the rank level represented by the rank information of the ink tank 1 is '0', the illumination duty of the corresponding LED 101A is set to a maximum of 100%, as shown in FIG. 10, so that the LED 101A is continuously illuminated. The continuous illumination of the LED 101A presents maximum brightness to the human eyes.

The output controller 1103 clears the LED driving signal 1108 with a signal obtained by the AND process of the serial data and the illumination allowing signal 1106. More specifically, when the illumination allowing signal 1106 is set to the L level, the LED driving signal 1108 is also inactivated. The illumination allowing signal 1106 is set to the L level for a time longer than the time calculated as {(the number of bits of the shift register 1102)×(the period of the data transmission clock 105)}, so that the data stored in the shift register 1102 is cleared.

In addition, when the continuous illumination signal 1107 is at the H level, the LED 101A is continuously illuminated irrespective of the rank data 1104 and the state of the illumination allowing signal 1106. The continuous illumination of the LED 101A is effective when the mounting position of the corresponding ink tank 1 is to be determined. In addition, the continuous illumination is also effective when the brightness level of the LED 101A is measured or when the storage element 1120 is in the initial state and the brightness rank data 1104 is not determined. Thus, the LED 101A can be continuously illuminated by setting the continuous illumination signal 1107 at the H level.

The light-amount rank data 1104 stored in the storage element 1120 is determined from the result of measurement performed when the ink tank 1 is shipped. More specifically, when the ink tank 1 is shipped, the LED 101A is illuminated to measure the brightness of the display unit 122 and data corresponding to the measurement result is stored as the rank data 1104.

Figure 11:
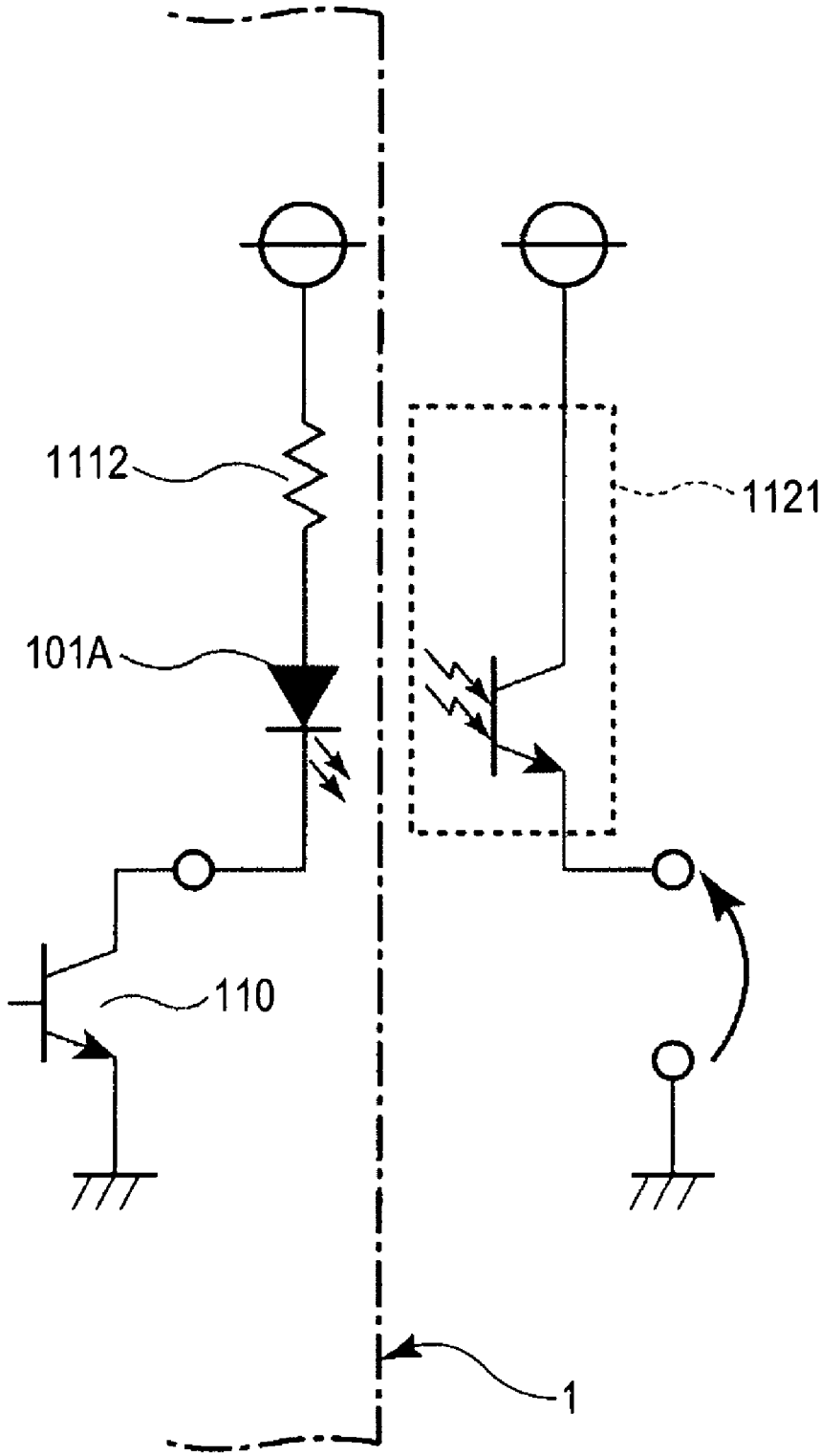
FIG. 11 is a schematic diagram illustrating a detection circuit for detecting an amount of light emitted from the LED shown FIG. 9.

FIG. 11 is a diagram illustrating an example of a method for measuring the brightness of the display unit 122.

Referring to FIG. 11, a light-amount measuring circuit 1121 for measuring the amount of light includes a phototransistor that functions as a light receiving device. However, other elements may also be used as the light receiving device. When the above-described continuous illumination signal 1107 is used, the LED 101A can be continuously illuminated even when the rank data 1104 is not yet stored in the initial state. The brightness of the display unit 122 is measured while the LED 101A is continuously illuminated. The brightness of the continuously illuminated LED 101A has individual differences due to the influence of the precision of the LED 101A and the resistor 1112, lot differences, etc. The variation in the visual brightness due to the individual differences can be reduced by setting the rank data 1104 such that the brightness of each display unit 122 is set constant in accordance with the brightness measured by the light-amount measuring circuit 1121.

When the brightness of the display unit 122 is measured, the measurement result is also influenced by the performance variation of the light guide member 121. Therefore, the brightness of the display unit 122 can be set constant without being affected by the variation of the light guide member 121 by setting the rank data 1104 on the basis of the measurement result. The illumination of the LED 101A may also be directly viewed by the user. In such a case, the performance variation of the light guide member 121 is not included in the result of brightness measurement of the LED 101A, and the rank data 1104 is set in accordance with the variation in the amount of light emitted from the LED 101A. In addition, when a circuit similar to the light-amount measuring circuit 1121 is provided in the printer main body, the attachment position of the ink tank 1 in the printer main body can be confirmed.

Thus, according to the present embodiment, the control element in the IC package 103 included in each ink tank 1 performs the control process for reducing the variation in the amount of light emitted from the LED 101A. In addition, similar to the first embodiment, the control process for illuminating the LED 101A to present the information regarding the amount of ink remaining in each ink tank 1 or the like to the user is performed by the control circuit 300 in the printer main body.

Other Embodiments

The illumination patterns for illuminating the light-emitting elements, such as LEDs, in the light-emitting units to present the information regarding the amount of ink remaining in the ink tanks or the like to the user may be determined arbitrarily. For example, blinking intervals may be changed or continuous illumination may be performed depending on the importance of the information to be presented. In addition, the information presented in the form of illumination of the light-emitting units is not limited to the information regarding the amount of remaining ink and may be, for example, information of whether or not each ink tank is properly attached.

In addition, the type of light-emitting elements included in the light-emitting units, the structure of the display units, and the structure of the light guide members provided between the light-emitting units and the corresponding display units are not limited, and the light-emitting units may also function as the display units to omit the light guide members. In either case, the brightness of the display unit can be made constant in each ink tank by controlling the light-emitting unit on the basis of the information regarding the brightness (amount or intensity of light) of the light-emitting unit and the display unit included in the ink tank. The ink tanks may be integrated with the corresponding recording heads in an inkjet cartridge.

The present invention may be applied to various types of liquid containers for storing various liquids other than ink used in a recording apparatus. For example, processing solvents applied to the recording medium to improve recording performance or water resistance may also be stored in the liquid container according to the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2004-374490 filed Dec. 24, 2004, which is hereby incorporated by reference herein in its entirety.

What is claimed is:

1. An ink container mounted to an inkjet recording apparatus having a mounting unit configured to be mounted with the ink container and a detecting unit configured to detect light emitted from a light-emitting unit provided to the ink container, the ink container adapted to contain ink used in the inkjet recording apparatus, the container comprising:

a substrate having a light-emitting unit and a contact receiving an electrical signal supplied by the inkjet recording apparatus;

a light guide unit disposed with a space to a wall; and an information storing medium storing individual information about the ink, wherein the light guide includes a light entrance unit configured to receive light from the light-emitting unit and a display light exit unit, wherein light entering through the entrance unit exits with floodlighting to outside, and wherein the information storing medium performs setting by classifying a light-emitting amount emitted from the light-emitting unit and output from the display unit via the light guide unit into a plurality of ranks, and stores the set rank information.

2. An ink container according to claim 1, wherein variation in the amount of light emitted from the light-emitting unit is reduced by making a driving pulse shorter when the light output from the display unit is bright, and making the driving pulse longer when the light output from the display unit is dark.

3. An ink container according to claim 1, wherein variation in the amount of light emitted from the light-emitting unit is reduced by making a light-emitting period shorter when the light output from the display unit is brighter, and making the light-emitting period longer when the light output from the display unit is dark.

4. An ink container according to claim 1, wherein the light-emitting frequency of the light-emitting unit is 100 Hz or more.

* * * * *